US006659513B1

(12) United States Patent
Ramsauer

(10) Patent No.: US 6,659,513 B1
(45) Date of Patent: Dec. 9, 2003

(54) CLOSURE FOR CONNECTING TWO THIN WALLS

(76) Inventor: Dieter Ramsauer, Am Neuhauskothen 20, D-42555 Velbert (DE)

( * ) Notice: Subject to any disclaimer, the term of this patent is extended or adjusted under 35 U.S.C. 154(b) by 85 days.

(21) Appl. No.: 09/913,748

(22) PCT Filed: Oct. 27, 2000

(86) PCT No.: PCT/EP00/10613

§ 371 (c)(1),
(2), (4) Date: Dec. 10, 2001

(87) PCT Pub. No.: WO01/44608

PCT Pub. Date: Jun. 21, 2001

(30) Foreign Application Priority Data

Dec. 17, 1999 (DE) ..... 299 22 195 U

(51) Int. Cl.[7] ..... E05C 5/00

(52) U.S. Cl. ..... 292/66; 292/64; 292/71; 292/DIG. 45

(58) Field of Search ..... 292/57, 58, 59, 292/71, 66, 68, 229, 217, 200, 257, DIG. 45, 60, 61; 411/550, 552, 549, 349; 229/60

(56) References Cited

U.S. PATENT DOCUMENTS 416,359 A * 12/1889 Cooley ..... 24/221 R
2,305,438 A * 12/1942 Michaels ..... 251/132
3,402,958 A * 9/1968 Barry ..... 292/62
3,956,803 A * 5/1976 Leitner ..... 24/221 R
4,688,835 A * 8/1987 Wu ..... 292/59
4,763,935 A * 8/1988 Bisbing ..... 292/66
5,073,075 A * 12/1991 Duran ..... 411/552
5,368,347 A * 11/1994 Holtman et al. ..... 292/257
5,688,002 A * 11/1997 Riley et al. ..... 292/92
5,931,516 A * 8/1999 Holtman et al. ..... 292/257
6,044,673 A * 4/2000 Jefferson ..... 70/212
6,267,543 B1 * 7/2001 David et al. ..... 411/552

FOREIGN PATENT DOCUMENTS

DE 44 23 406 1/1995

* cited by examiner

*Primary Examiner*—James R. Brittain
*Assistant Examiner*—André L. Jackson
(74) *Attorney, Agent, or Firm*—Reed Smith LLP

(57) ABSTRACT

A closure, for connecting two thin walls, such as a sheet metal cabinet door to a sheet metal cabinet frame is disclosed, which comprises a bearing piece, arranged in or on an opening in the first thin wall and a shaft, retained in the bearing piece and which may be rotated and axially displaced therein. A pivoting lever is mounted on the on outer end of the shaft and, on the other inner end of the shaft, a retaining piece is arranged, which may be engaged with an opening in the second thin wall. The retaining piece comprises a cupular guide piece and a sleeve piece, which may be inserted in and rotated in the cupular guide piece against the force of a spring. A catch projects from said sleeve piece in the direction of the wall plane which, in the locked position, extends beyond the outer surface of the guide piece as far as the rear surface of the second thin wall and rests thereon.

18 Claims, 6 Drawing Sheets

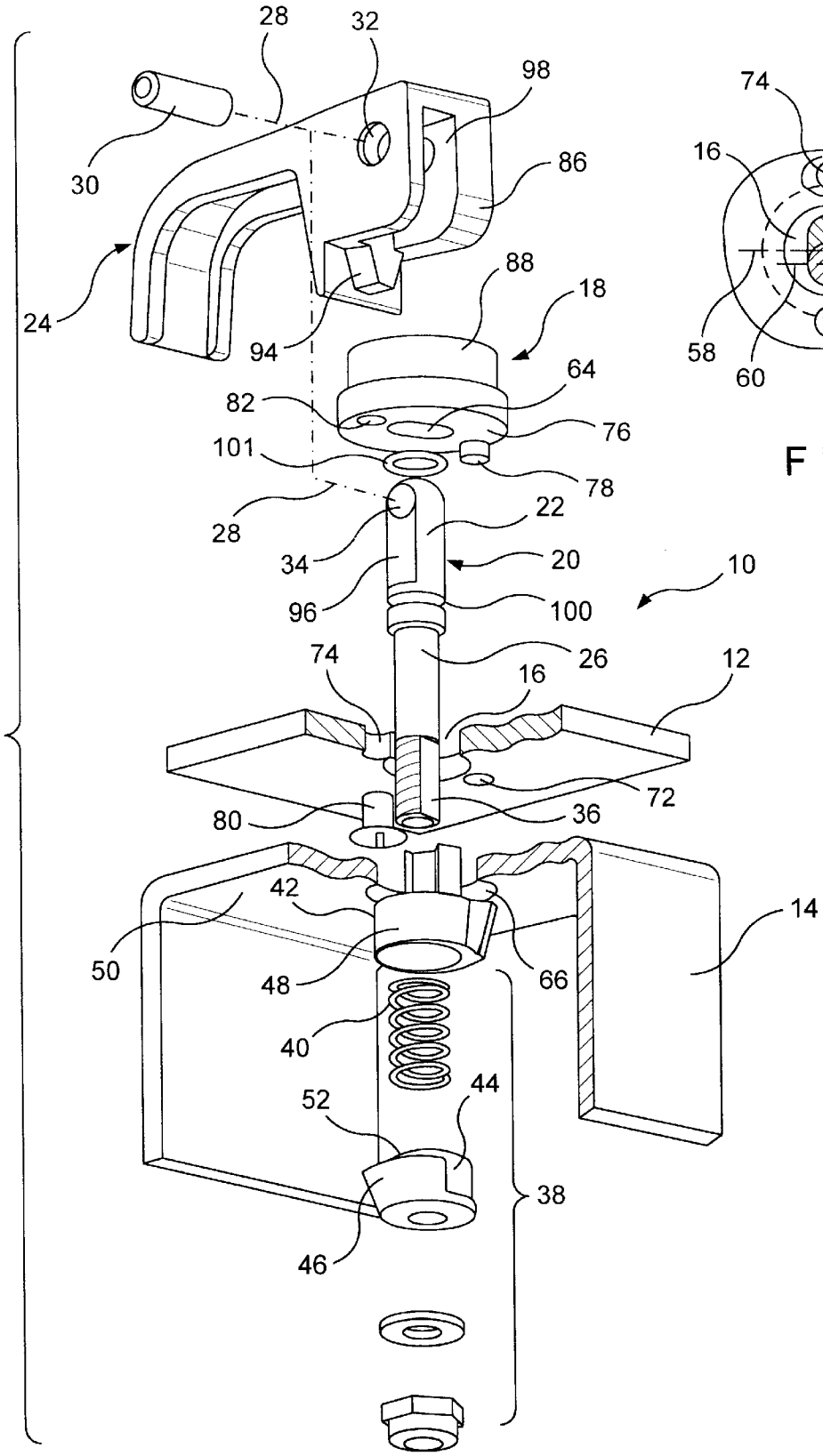
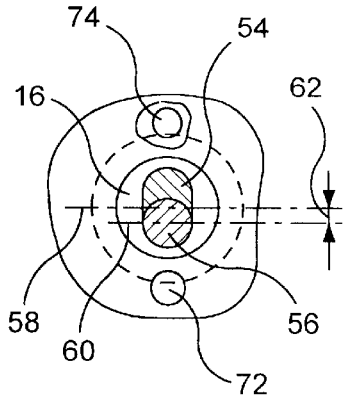
FIG. 2
FIG. 1

CLOSURE FOR CONNECTING TWO THIN WALLS

CROSS-REFERENCE TO RELATED APPLICATIONS

This application claims priority of International Application No. PCT/EP00/10613, filed Oct. 27, 2000 and German Application No. 299 22 195.4, filed Dec. 17, 1999, the complete disclosures of which are hereby incorporated by reference.

BACKGROUND OF THE INVENTION a) Field of the Invention

The invention is directed to a closure for connecting two thin walls, such as sheet metal cabinet doors to sheet metal cabinet frames, which comprises a bearing piece, mounted in or on an opening in the first thin wall and a shaft, retained in the bearing piece wherein it may be rotated and axially displaced. A pivoting lever is mounted on the one, outer end of the shaft and, on the other, inner end of the shaft, a retaining piece is arranged, wherein the pivoting lever can be pivoted from a first, open position where the shaft is in a first axially loaded position into a second, closed position where the shaft has been displaced axially outwards against the force of a spring.

b) Description of the Related Art

Such a closure is already known, cf. for example DE 44 23 406 A1.

The object referred to as an "Ausbauchverschluss" (convex or bellying closure) in this document makes it possible to secure two plate-like parts to each other or one plate-like part to a corresponding frame. The closure described in this document has the advantage of great simplicity, since it needs relatively few parts and can be fitted relatively simply.

Nonetheless, it also has disadvantages that forbid its use for certain applications. Especially when the closure is supposed to work at low temperatures, as they are for example present in refrigerating chambers, resulting in the disadvantage that the body of expanded material, which for example consists of elastic rubber or plastic, loses its elasticity because of the low temperature and could even break if this leads to brittleness.

There is the further disadvantage that the closure is immediately open completely when the operating lever is swung open accidentally, so that there is a risk that the two thin walls move apart unintentionally, which can for example lead to a refrigerating chamber being opened unintentionally.

OBJECT OF THE INVENTION

It is the primary object of the invention to improve a closure of the type described in the opening section in such a way that the described disadvantages no longer occur.

In accordance with the invention, this object is met by making the retaining piece comprise a cupular guide piece and a sleeve piece, which may be inserted in and rotated in the cupular guide piece against the force of a spring. A catch projects from said sleeve piece in the direction of the wall plane which, in the engaged position, extends beyond the outer surface of the guide piece as far as the rear surface of the second thin wall and rests thereon.

First of all, these features avoid the use of a body of expanded material, which at low temperatures might not be sufficiently flexible anymore and therefore might lose its function or break during attempts of use because of brittleness, and the ability of the two connected walls to move completely away from each other when the pivoting operating lever is swung away is also removed. When the operating lever of the closure according to the invention is merely swung open, the closure is opened and the connection of the two walls is loosened, but the two walls can not be separated from each other; for this, the lever handle must additionally be rotated, for example by 180 degrees.

Whereas in prior art the spring forces and locking forces must be generated by the body of expanded material, resulting in the described disadvantages at low temperatures, the novel closure according to a further development of the invention has the spring force being generated by a spiral spring arranged between the bottom of the cup of the guide piece on one side and on the face of the sleeve facing the bottom of the cup on the other side. This spring is largely independent of temperature influences.

So that as in prior art the construction and installation are as simple as possible, it is advantageous if the opening in the second thin wall is circular with two widening sections (for example corresponding to the cross-section of a two-way key) and if the catch part can be slid through the opening like a bayonet in one rotary position of the rotating sleeve part but not in another position, for example one rotated by 90 degrees.

If one wants to avoid the expense of producing a two-way key opening in the door-frame, according to another embodiment form the shaft could be guided through the bottom of the cup in a location that is eccentric relative to the circumference of the cup. This makes it possible for the catch to engage behind the wall in a first rotary position, while in a second rotary position the catch can be passed through the opening.

According to yet another embodiment form of the invention, the lever can form a cam surface that rests on the outer face of the bearing piece. For prior art, the corresponding support is formed by the thin wall itself, which simplifies construction, but on the other hand can lead to unsightly paint damage that can lead to the formation of rust in visible places.

The outer face of the bearing piece can form a groove shaped like part of a circle or a conical depression into which lugs, carried or formed by the lever, extend during its closing pivoting movement. This makes it possible to only allow the closing pivoting movement of the lever in such a position that is optimally suitable, whereas in other positions the pivoting of the lever is not possible because of the lack of a grooved area. This has the advantage that a closing pivoting movement is only possible in a position where the catch engages sufficiently safely behind the second wall.

According to yet another embodiment of the invention, the sleeve carrying the catch is held on the shaft by a self-locking nut. This has the advantage that the closing force can be set as required by way of screwing the nut further onto or off the bolt.

According to yet another embodiment of the invention, it can also be advantageous to place a spring washer between the self-locking nut and the catch sleeve for the purpose of compensating for small differences in tolerance.

According to yet another embodiment of the invention, it is advantageous for the outside of the bottom of the cupular part to have a projection which is matched by a correspondingly shaped opening in the thin wall in such a way that the cupular part is secured against rotation relative to the thin wall; this is to ensure that the cupular part does not twist relative to the thin wall and in so doing makes a closing position indefinable.

The projection could in particular have a non-round cross-section which fits into an opening in the thin wall which also has a non-round cross-section and thus is secured against twisting.

Alternatively, the thin wall could also have additional openings into which lugs coming from the bearing protrude, but this does require additional openings in the thin wall, which sometimes are impractical.

Instead of the lug or the several lugs, threaded boreholes can be provided into which (countersunk head-) screws can be screwed which come from the bearing or which can be passed through corresponding boreholes in the bearing.

This design is particularly tamper-proof.

A simple construction is made possible when according to another further development of the invention the opening in the first wall is an elongated hole into which the cross-section of the shaft fits essentially without any play. By this, securing it against rotation is achieved without additional boreholes, and the opportunity for adapting to different conditions also exists.

This is in particular the case if the opening in the first wall is an elongated hole into which the cross-section fits with play.

BRIEF DESCRIPTION OF THE DRAWINGS

The invention is subsequently to be described in more detail by means of embodiment examples shown in the drawings.

FIG. 1 shows an exploded view of an embodiment form of the closure for the connection of two thin walls according to the invention, which here are a sheet metal cabinet door and a sheet metal cabinet frame;

FIG. 2 shows a cross-sectional view whose sectional plane is close to the outside surface of the first thin wall;

FIG. 7 shows a perspective view of the closure shown in FIG. 6 but with the handle swung in;

DESCRIPTION OF THE PREFERRED EMBODIMENTS

Figure 3:
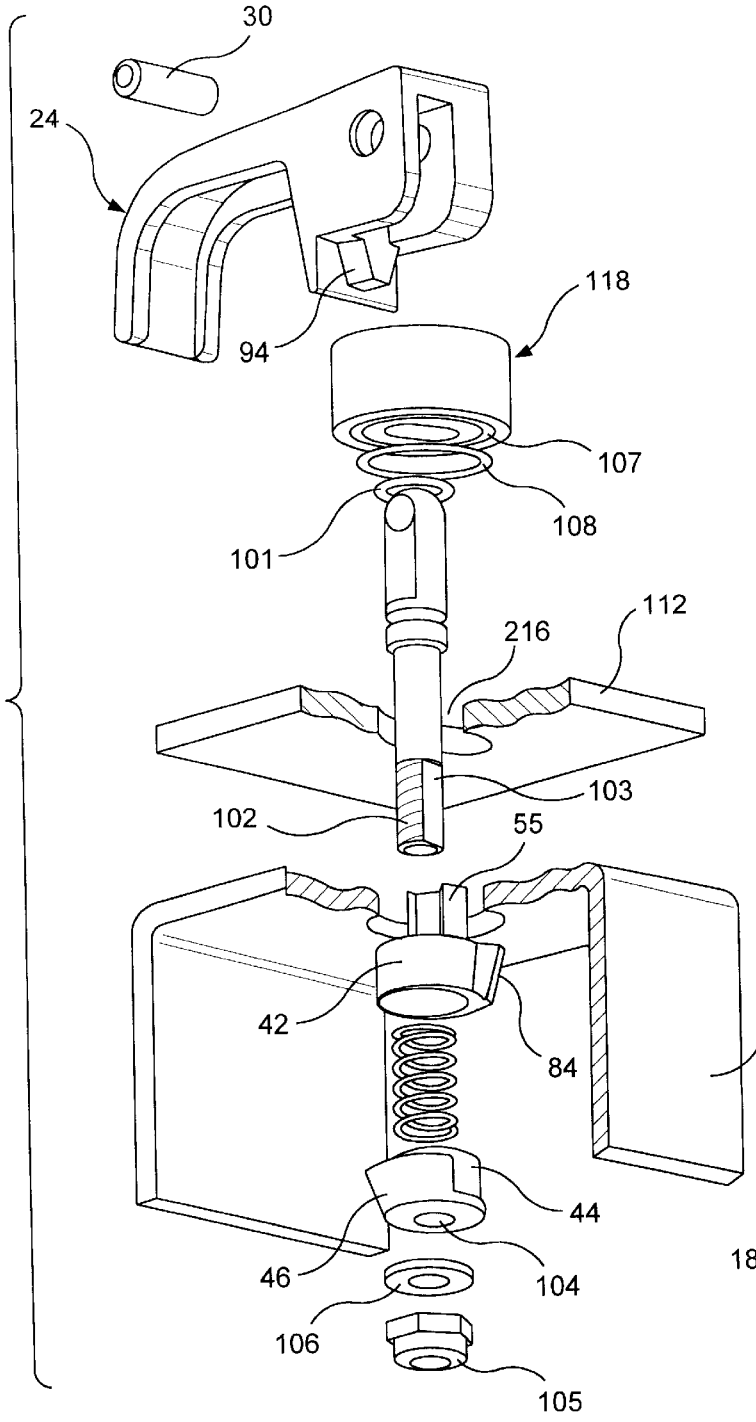
FIG. 3 shows in a representation similar to FIG. 2 an alternative embodiment form of the closure according to the invention which is secured against rotation by means of an elongated hole so that additional boreholes in the door leaf are not necessary.

FIG. 1 shows an exploded view of a closure 10 with which two thin walls, like for example a sheet metal cabinet door 12 and a sheet metal cabinet frame 14 can be connected.

The closure comprises a bearing piece 18 arranged in or on an opening 16 in the first thin wall 12 and a shaft 20, retained in the bearing piece wherein it may be rotated and axially displaced. A pivoting lever 24, which can be pivoted on an axis 28 that is vertical to the axis 26 of the shaft 20 is mounted on the one outer end 22 of the shaft 20, for example held by a pin 30, which on one side is inserted in a borehole 32 in the jointed end of the lever 24 and on the other side is inserted in a transverse bore 34 on the end of the shaft 20 and which is secured appropriately.

Figure 7:
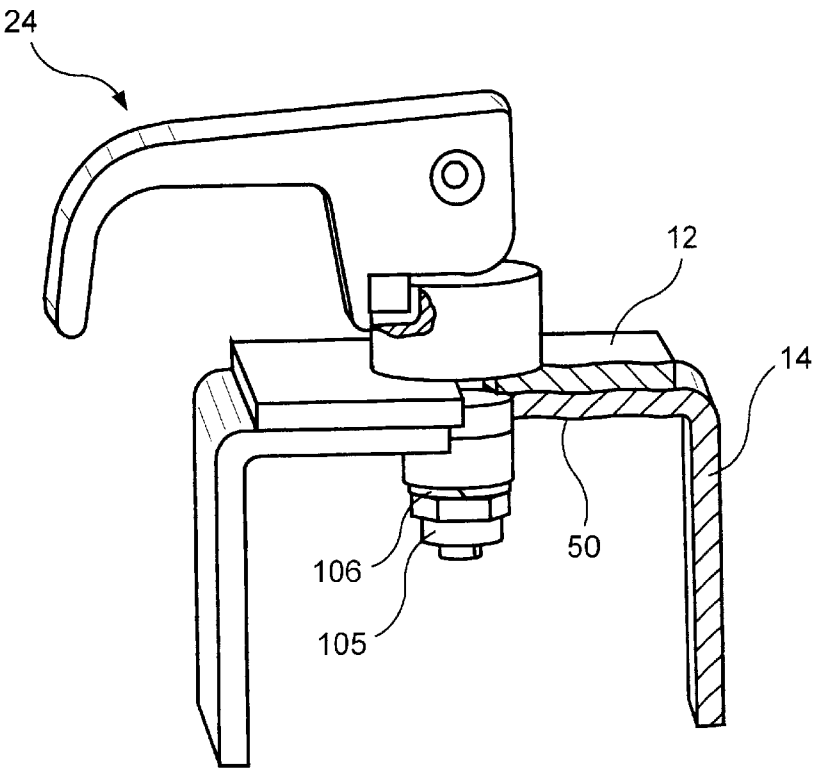
Figure 6:
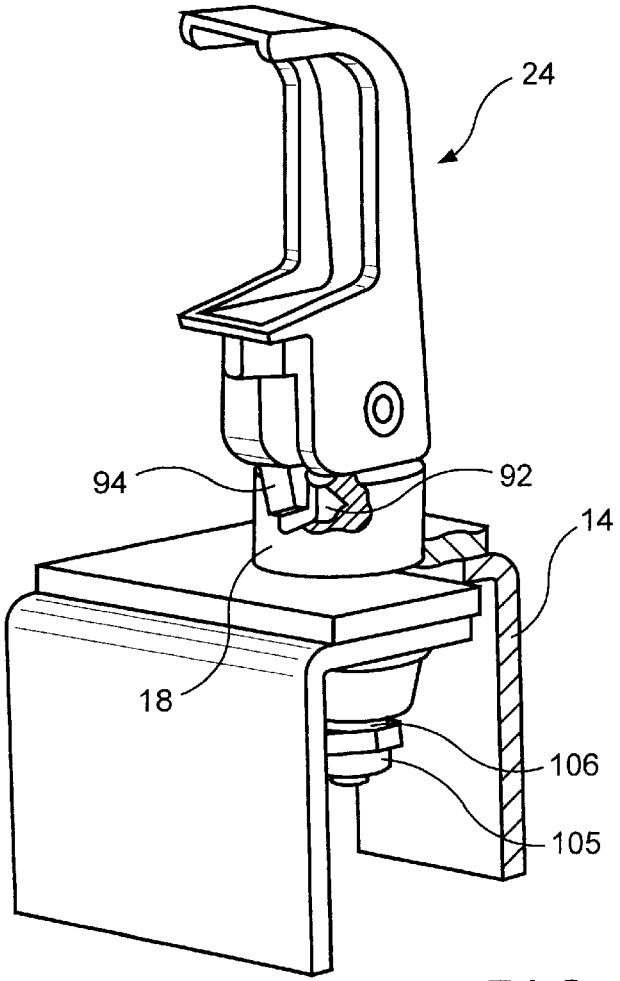
FIG. 6 shows a perspective view of the arrangement according to FIG. 3, but in the assembled state, wherein the closure can be seen in the swung open position.

On the other, inner end 36 of the shaft 20, a retaining piece 38 is arranged, wherein the pivoting lever 24 can be pivoted from its first, open position, for example shown in FIG. 6, where the shaft is in a first axial thrust exerting position, into a second, closed position—cf. FIG. 7—where the shaft is displaced axially outward (towards the pivoting lever 24) against the force of a spring 40.

Figure 8B:
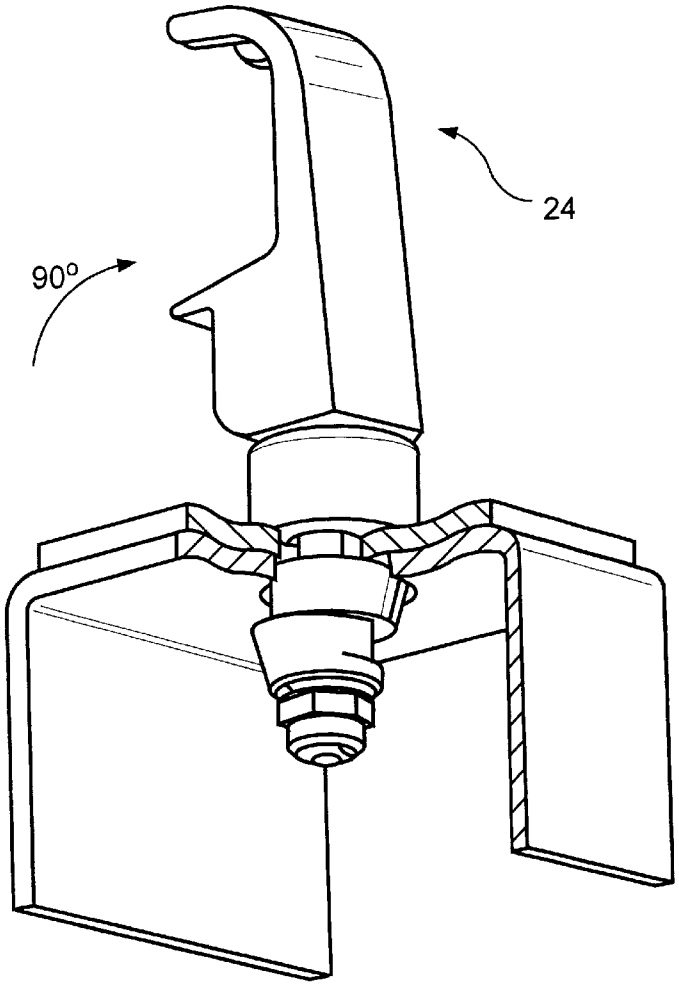
FIG. 8B shows the lever handle swung up and consequently the loosened closure.
Figure 8A:
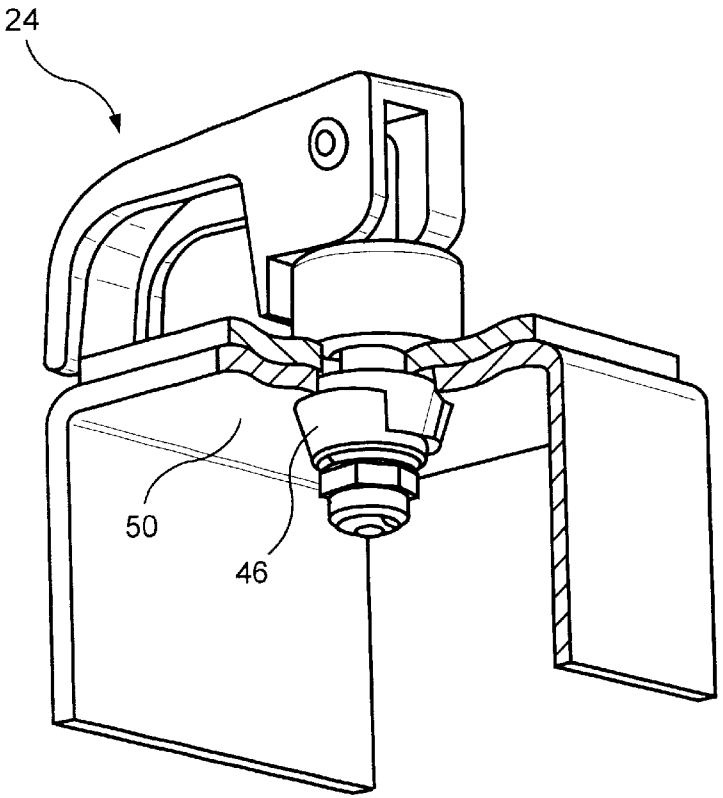
FIG. 8A shows the closure in the closed position.

The retaining piece 38 comprises a cupular guide piece 42 and a sleeve piece 44, which may be inserted and rotated in the cupular guide piece 42 against the force of a spring 40; a catch 46 bent back towards the wall plane 50 projects from said sleeve piece 44 and, in the locked position, extends beyond the outer surface 48 of the guide piece 42 as far as the rear surface 50 of the second thin wall 14 and rests thereon, cf. for example FIG. 7 and FIG. 8A.

As already mentioned, the spring force is generated by a spring 40 which has been slid onto the shaft 20 and which can be arranged between the bottom of the cup (not shown) on one side and the annular face 52 of the sleeve 44 facing the bottom of the cup. The annular face could here also have a ring-shaped groove into which part of the spring penetrates, giving it a greater longitudinal extent, so that the spring effect of the pressure spring 40 can be more even.

Figure 8D:
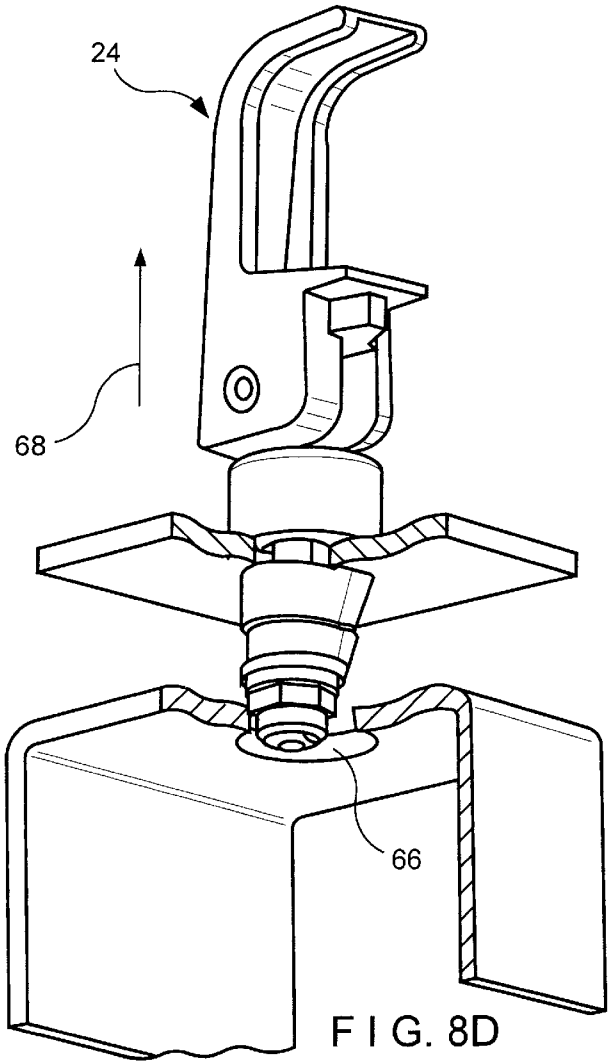
FIG. 8 shows the handle according to the invention in partial FIGS. A, B, C and D, wherein the different partial Figures show different phases of opening.
In FIG. 8C, the handle has been rotated by 180 degrees so that according to FIG. 8D the two thin walls can be separated from each other and, for example, the door leaf can be swung away from the door frame.
Figure 8C:
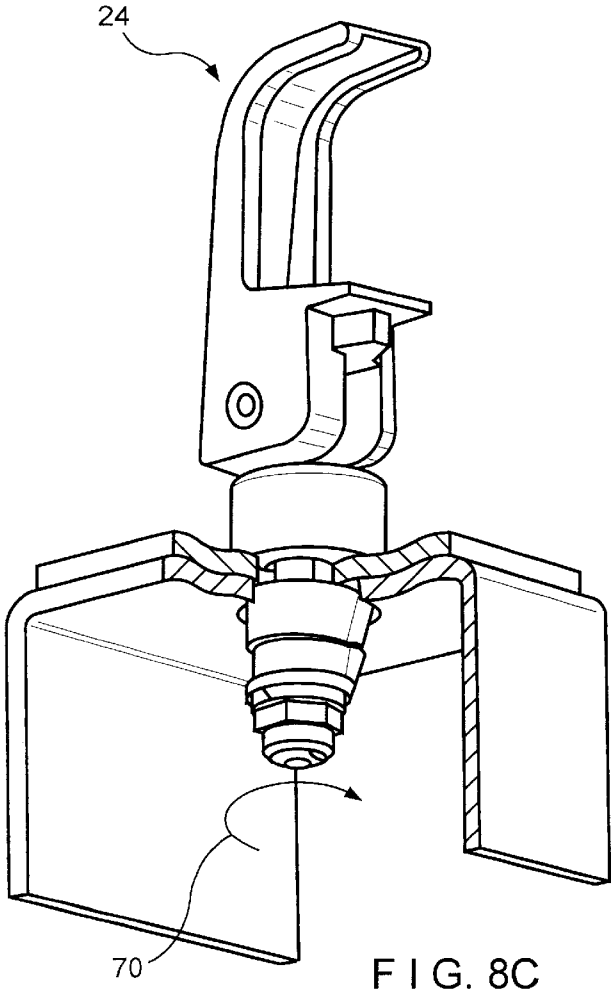

From the cup-bottom of the cupular guide piece 42 a projection 55 protrudes (cf. FIG. 3) which on one side delimits the opening 56 provided in the cup-bottom for the shaft 26 in such a way that together they result in an elongated, non-round cross-section, cf. the cross-section according to FIG. 2. This joint oval, elongated cross-section has a bisecting line 58 which defines a center line and which varies from a corresponding bisecting line 60 of the cross-section 56 of the shaft 20 by a certain quantity 62. When assembled, the two cross-sections 54, 56 are housed by an opening 64 in the bearing piece 18 which is also non-round and of a matching shape. In consequence, the shaft 20 is arranged eccentrically by the quantity 62 relative to the bearing piece 18 and the guide piece 42 housed by it. This has the consequence that in the position of the lever to be seen in the FIGS. 8A and 8B the catch protrudes beyond the outside wall 48 of the guide piece 42 by a distance which is roughly equivalent to double the eccentricity 62; but in a direction 180 degrees opposite to this (cf. FIGS. 8C and 8D), it is flush with this outside wall, so that in this position the two pieces 42 and 46 can be passed through the opening 66 which is slightly larger than the cupular component 42 so that according to FIG. 8D the thin wall 14, which is for example the door frame, can be separated from the wall 12, which is for example the door leaf; cf. the arrow 68 in FIG. 8D.

To ensure that for a rotating movement of the lever handle 24 (cf. the arrow 70 according to FIG. 8C) the eccentric movement between the sleeve piece 44 holding the catch 46 on one side and the guide piece 42 guiding the sleeve 44 on the other side actually occurs, it must be ensured that the sleeve piece 44 can not twist relative to the door leaf or the thin wall 12. According to the embodiment form in FIG. 1, this is done by holding the projection (together with the shaft 20) in the corresponding non-round cross-section of the bearing piece 18 in such a way that a torsion-proof connection results between the components 42 and 18. In turn, the piece 18 can be connected to the door leaf 12 in a manner that is torsion-proof; for example by means of additional openings 72, 74 in the thin wall through which either toes 78 projecting from the supporting surface 76 of the bearing piece 18 on the thin wall 12 are inserted into boreholes 72, 74, or by fixing screws 80 coming from the bearing surface 76 in threaded boreholes, wherein in turn the cap screws 80 may be guided through the openings 72 or 74.

For this type of attachment, it does not matter what shape the opening 16 has, as long as there is a sufficient amount of space for the passage of the joint cross-section of the shaft 20 and the projection 55, cf. FIG. 2.

Figure 4:
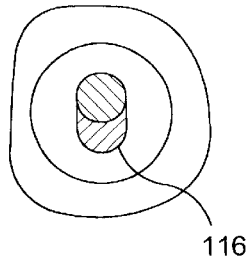
FIG. 4 shows a cross-sectional view similar to FIG. 2 for the representation of an embodiment form.

Nonetheless, according to FIGS. 3 and 4, the design is such that the opening 116 has exactly the same shape as the cross-section of the projection and the shaft so that here the bore itself makes a securing against rotation possible. By means of this, additional component parts like projections 78 and screws 80 are no longer necessary. The need for corresponding openings 72, 74 in the door leaf 112 also no longer applies.

Figure 5:
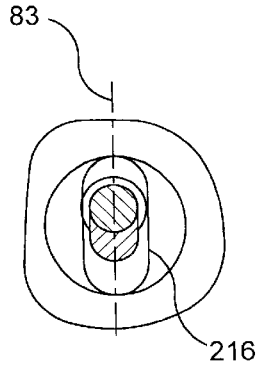
FIG. 5 shows a view similar to FIG. 4 for the representation of another embodiment form.

Even if there is some residual play between this cross-section and the corresponding opening 216 according to FIG. 5, in particular in direction of the axis 83 according to FIG. 5, the elongated shape of the joint cross-section of shaft and projection prevents twisting inside this elongated borehole 216; on the other hand, a movement inside this elongated borehole 216 along its longitudinal axis is made possible; this can be advantageous for certain applications, for example when the door 112 and the door frame 114 have been warped relative to each other so that the two openings 116 and 216 do not align with each other exactly any more. This makes closing the arrangement easier; what also makes the closing process easier is the fact that the catch 46 shown in FIG. 3 on the one hand and a corresponding portion 84 of the guide piece 42 on the other hand are shaped like a cone.

As can be gathered from the Figures, the lever 24 forms a cam surface 86 which rests on the outer face 88 of the bearing piece 18. As it is known in the art, this cam surface 86 has such a shape relative to the axis 28 that the desired traction movement results during the pivoting of the lever 24. To ensure that the closing movement of the lever 24, meaning the movement from the position according to FIG. 8A to the one according to FIG. 8B, arrow 90, can only take place when the catch 46 is in the protruding position according to FIG. 8B, provisions have been made for the outer face 88 of the bearing piece to form a groove shaped like part of a circle or a depression 92 into which a lug 94 carried or formed by the lever 24 extends during its closing pivoting movement, cf. FIGS. 6 and 7. By means of this, the inwards pivoting movement for tightening the closure and therefore for pressing the catch against the inside surface of the thin wall 14 can only take place in a position where the catch front face can actually grip this wall; this is the position shown in FIG. 8B.

Because the lug forms an obstruction, the absence of the depression or of the groove formed like part of a circle prevents the inward pivoting of the lever 24 if the lever handle 24 is not in this optimal position.

What also should be mentioned is the flattened portion 96 on the end of the shaft 20 which can be made out in FIG. 1 and which facilitates its improved guidance between the side walls 98 of the slit formed by the lever 24.

A ring-shaped groove 100 in the shaft 20, which also can be made out in FIG. 1, can be used for providing an O-ring seal 101. The other end 36 of the shaft 20 has a peripheral thread 102, also with a flattened portion 103, so that a torsion-proof attachment of the sleeve piece 44 is made possible because of a correspondingly shaped non-round opening 104, while the self-locking nut 105 makes setting the tightness of the closure possible. If one then arranges a spring washer 106 between the self-locking nut on one side and the sleeve piece 44 on the other side, tolerances of, for example, the thickness of the walls 112, 114, can be compensated for; cf. FIG. 3.

Figure 9:
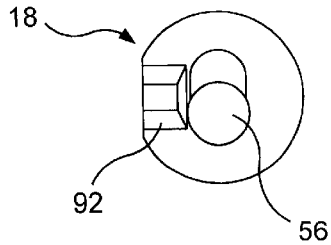
FIG. 9 shows the bearing piece of the closure according to FIG. 3 in a view from above.

FIG. 9 shows the groove shaped like part of a circle 52, here in the shape of a short depression with wedge-shaped walls, into which a corresponding wedge-shape of the projection 94 fits precisely.

The wedge-shape ensures that the inward pivoting movement requires no great effort, even when the lever 24 is not aligned precisely.

According to FIG. 3, a groove 107 has been made in the surface with which the bearing piece 118 rests on the thin wall 112 into which an O-ring seal 108 can be inserted. If additionally the aforementioned sealing washer 101 is provided in the groove 100, the arrangement is made waterproof by means of this.

Figure 10:
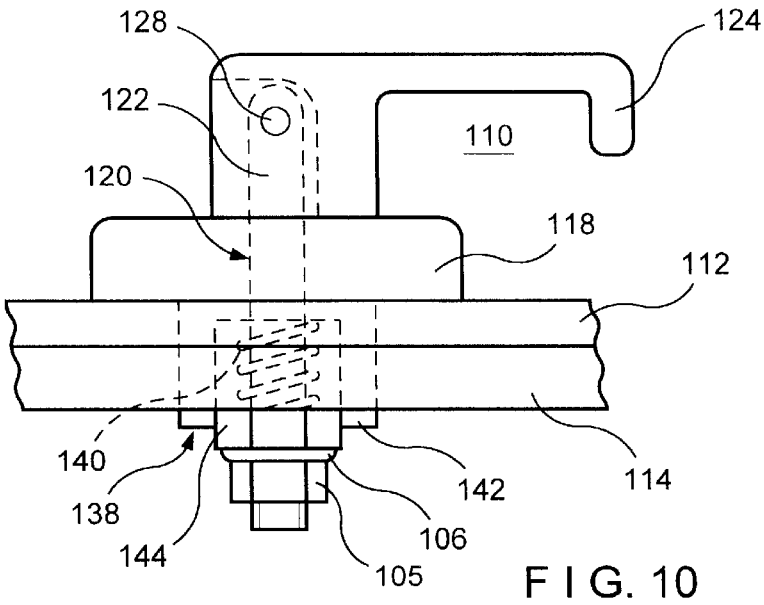
FIG. 10 shows a closure according to another, bayonet-like embodiment form in the closed position in a side view.
Figure 11:
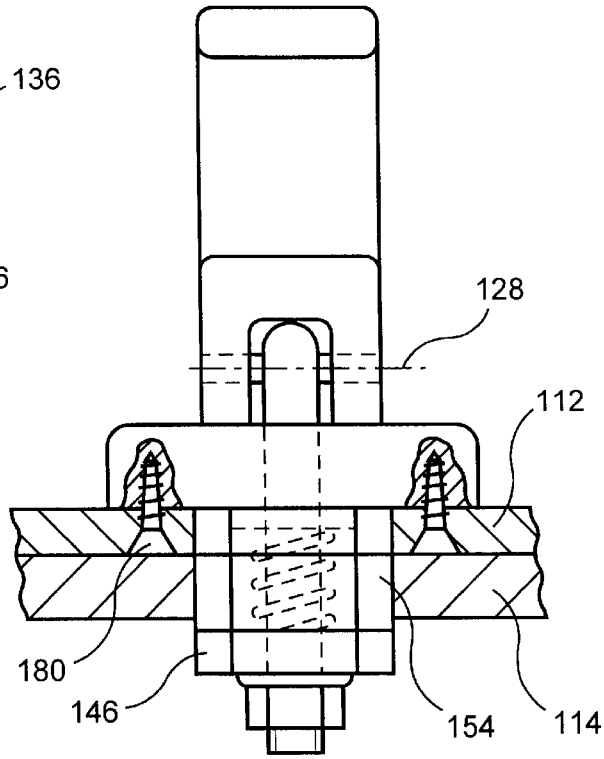
FIG. 11 shows the closure from FIG. 10 in a partially sectional view in the opened position.

FIG. 10 shows the side view of a closure 110 according to another, bayonet-like embodiment form in the closed position, while FIG. 11 shows the closure 110 in a partially sectional view in the opened position. The first thin wall 112 and the second thin wall 114 here have round holes of the same size, but the round hole in the second thin wall has additionally been provided with two wider portions lying opposite to each other (for example, corresponding to the cross-section of a two-way key), so that in one rotary position of the rotating sleeve 144, the catch 146 can be passed through the opening like a bayonet, but not in another position which, for example, is offset by a rotation of 90 degrees.

Here also, the bearing piece 118 is screwed to the first thin wall 112 by means of countersunk head screws 180; the other parts are also provided analogously, as can be gathered from the references to which the prefix "1" has been added.

Figure 12:
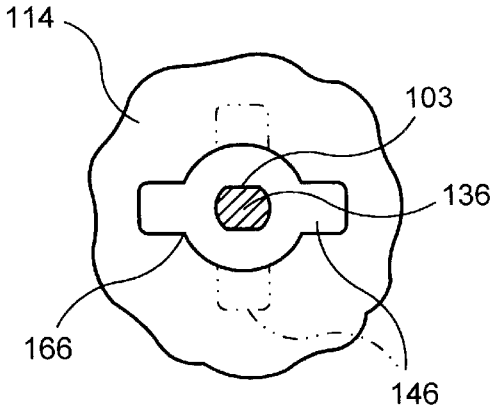
FIG. 12 shows diagrammatically the two-way key form of the opening in the second wall (door frame) and the matching retaining part in the opened and closed position.

FIG. 12 shows diagrammatically the two-way key shape of the opening in the second thin wall (doorframe) 114 and the matching retaining piece 138, in the opened and in the closed position.

Although the expense at which the two-way key opening in the door frame is produced is a little bit higher than for a plain round opening like the one according to the embodiment form in FIG. 1, the shape of the closure is on the other hand a little bit simpler.

The invention can be applied industrially in the field of switch cabinet construction.

While the foregoing description and drawings represent the present invention, it will be obvious to those skilled in the art that various changes may be made therein without departing from the true spirit and scope of the present invention.

What is claimed is:

1. A closure for connecting two thin walls, like a sheet metal cabinet door and a sheet metal door frame to each other, comprising:

a bearing piece being arranged in or on an opening in a first thin wall, such as a door;

a shaft being retained in the bearing piece and which may be rotated and axially displaced therein;

on an outer end of said shaft, a pivoting lever being mounted, which can be pivoted on an axis that is vertical to an axis of the shaft;

on an inner end of the shaft, a retaining piece being arranged, wherein the pivoting lever can be pivoted from a first open position in which the shaft is in a first axial thrust exerting position, into a second closed position in which the shaft is displaced axially outward towards the pivoting lever against the force of a spring;

said retaining piece comprising a cupular guide piece and a sleeve piece, which may be inserted in and rotated in the cupular guide piece against the force of a spring;

a catch projecting from said sleeve piece in the direction of the wall plane; and in a locked position, the projecting of the catch extends beyond an outer surface of the guide piece as far as a rear surface of a second thin wall and rests thereon;

wherein a sleeve bearing and a catch sleeve are held on the shaft by a self-locking nut.

2. The closure according to claim 1, wherein an opening arranged in the second thin wall is circular with widening portions preferably arranged opposite to each other and wherein the catch can, in the manner of a bayonet, be passed through an opening in a first rotary position of a rotating sleeve but not in another position.

3. The closure according to claim 1, wherein the lever forms a cam surface which rests on an outside face of the bearing piece.

4. The closure according to claim 1, wherein an outside face of the bearing piece forms a groove in the shape of part of a circle or of a conical depression into which a lug formed or carried by the lever dips during the closing pivoting movement of the lever.

5. The closure according to claim 1, wherein a spring washer is arranged between the self-locking nut and the catch sleeve.

6. The closure according to claim 1, wherein the outside surfaces of the catch or the cupular guide piece have a conical shape.

7. The closure according to claim 1, wherein sealing devices are provided which seal off spaces separated by the first thin wall from each other.

8. The closure according to claim 1, wherein the spring force originates from a spiral pressure spring arranged between the cup bottom of the guide piece on one side and the annular face of the sleeve pointing towards the cup bottom.

9. The closure according to claim 8, wherein the catch is passed through the opening at a 90 degree rotary offset.

10. The closure according to claim 8, wherein the shaft is eccentric relative to the outside circumference of a cup.

11. The closure according to claim 1, wherein the thin wall has openings into which lugs protruding from the bearing piece penetrate.

12. The closure according to claim 11, wherein instead of the lugs, threaded boreholes are provided into which countersunk head screws, can be screwed which have been passed through the openings provided in the first thin wall.

13. The closure according to claim 1, wherein a projection extends from the outside of the bottom of the cupular piece which can be received by a correspondingly shaped opening in the thin wall in such a way that the cupular guide piece is secured against rotation relative to the first thin wall.

14. The closure according to claim 13, wherein the projection has a non-round cross-section which can be held by the opening in the thin wall with a non-round cross-section in a manner that is secured against twisting.

15. The closure according to claim 13, wherein the opening in the first thin wall is an elongated hole which can hold a cross-section of the projection and the shaft without play.

16. The closure according to claim 13, wherein the opening in the first thin wall is an elongated hole which can hold the cross-section of the projection and the shaft with some play.

17. A closure for connecting two thin walls, like a sheet metal cabinet door and a sheet metal door frame to each other, comprising:

a bearing piece being arranged in or on an opening in a first thin wall, such as a door;

a shaft being retained in the bearing piece and which may be rotated and axially displaced therein;

on an outer end of said shaft, a pivoting lever being mounted, which can be pivoted on an axis that is vertical to an axis of the shaft;

on an inner end of the shaft, a retaining piece being arranged, wherein the pivoting lever can be pivoted from a first open position in which the shaft is in a first axial thrust exerting position, into a second closed position in which the shaft is displaced axially outward towards the pivoting lever against the force of a spring;

said retaining piece comprising a cupular guide piece and a sleeve piece, which may be inserted in and rotated in the cupular guide piece against the force of a spring;

a catch projecting from said sleeve piece in the direction of the wall plane; and in a locked position, the projecting of the catch extends beyond an outer surface of the guide piece as far as a rear surface of a second thin wall and rests thereon;

wherein the spring force originates from a spiral pressure spring arranged between the cup bottom of the guide piece on one side and the annular face of the sleeve pointing towards the cup bottom.

18. A closure for connecting two thin walls, like a sheet metal cabinet door and a sheet metal door frame to each other, comprising:

a bearing piece being arranged in or on an opening in a first thin wall, such as a door;

a shaft being retained in the bearing piece and which may be rotated and axially displaced therein;

on an outer end of said shaft, a pivoting lever being mounted, which can be pivoted on an axis that is vertical to an axis of the shaft;

on an inner end of the shaft, a retaining piece being arranged, wherein the pivoting lever can be pivoted from a first open position in which the shaft is in a first axial thrust exerting position, into a second closed position in which the shaft is displaced axially outward towards the pivoting lever against the force of a spring;

said retaining piece comprising a cupular guide piece and a sleeve piece, which may be inserted in and rotated in the cupular guide piece against the force of a spring;

a catch projecting from said sleeve piece in the direction of the wall plane; and in a locked position, the projecting of the catch extends beyond an outer surface of the guide piece as far as a rear surface of a second thin wall and rests thereon;

wherein an outside face of the bearing piece forms a groove in the shape of part of a circle or of a conical depression into which a lug formed or carried by the lever dips during the closing pivoting movement of the lever.

* * * * *